US006354093B2

(12) United States Patent
Davis et al.

(10) Patent No.: US 6,354,093 B2
(45) Date of Patent: Mar. 12, 2002

(54) CONTROL SYSTEM AND RELATED METHODS FOR REFRIGERATION AND FREEZER UNITS

(75) Inventors: Ronald Davis, Euless; Laura Lewis, Lipan; Alvin Slade, Forest Hill, all of TX (US)

(73) Assignee: Traulsen & Company, Inc., Fort Worth, TX (US)

( * ) Notice: Subject to any disclaimer, the term of this patent is extended or adjusted under 35 U.S.C. 154(b) by 0 days.

(21) Appl. No.: 09/900,434

(22) Filed: Jul. 6, 2001

Related U.S. Application Data

(62) Division of application No. 09/479,545, filed on Jan. 7, 2000, now Pat. No. 6,260,365.

(51) Int. Cl.[7] ..... F25D 17/06

(52) U.S. Cl. ..... 62/89; 62/127; 62/129; 62/158; 62/213

(58) Field of Search ..... 62/89, 126, 127, 62/129, 181, 213, 158

(56) References Cited

U.S. PATENT DOCUMENTS

| | | | | | |
|---|---|---|---|---|---|
| 3,707,851 | A | * | 1/1973 | McAshan, Jr. | 62/125 |
| 4,432,211 | A | | 2/1984 | Oishi et al. | 62/155 |
| 4,553,400 | A | * | 11/1985 | Branz | 62/127 |
| 4,689,965 | A | | 9/1987 | Janke et al. | 62/155 |
| 5,237,830 | A | | 8/1993 | Grant | 62/155 |
| 5,275,009 | A | * | 1/1994 | Kobayashi et al. | 62/129 |
| 5,483,804 | A | | 1/1996 | Ogawa et al. | 62/153 |
| 5,524,445 | A | * | 6/1996 | Morrow et al. | 62/129 |
| 5,564,286 | A | | 10/1996 | Suse | 62/153 |
| 5,692,385 | A | | 12/1997 | Hollenbeck et al. | 62/154 |
| 5,765,382 | A | | 6/1998 | Manning et al. | 62/154 |
| 5,813,242 | A | | 9/1998 | Lawrence et al. | 62/156 |
| 5,887,443 | A | | 3/1999 | Lee et al. | 62/153 |
| 5,934,087 | A | * | 8/1999 | Watanable et al. | 62/126 |
| 6,085,530 | A | * | 7/2000 | Barito | 62/126 |
| 6,131,400 | A | | 10/2000 | Seok et al. | 62/154 |

* cited by examiner

*Primary Examiner*—William E. Tapolcai
*Assistant Examiner*—Mohammad M. Ali
(74) *Attorney, Agent, or Firm*—Thompson Hine LLP

(57) ABSTRACT

A cooling system and related method of defrosting a refrigeration unit or a freezer unit involves the steps of (a) monitoring a compressor running time, (b) monitoring an evaporator coil temperature, (c) monitoring a first time period since a last cooled compartment door open alarm of the unit, (d) monitoring a second time period since a last defrost operation, (e) monitoring a third time period during which the cooled compartment door is closed, and (f) controlling initiation of a defrost operation as a function of the monitored compressor running time, the monitored evaporator coil temperature, the monitored first time period, the monitored second time period, and the monitored third time period. Various sets of conditions may be established for triggering initiation of the defrost operation. The system may also detect refrigerant leaks and a clogged condenser as a function of compressor running time and compressor discharge line temperature.

13 Claims, 4 Drawing Sheets

CONTROL SYSTEM AND RELATED METHODS FOR REFRIGERATION AND FREEZER UNITS

CROSS REFERENCE

This application is a divisional of application Ser. No. 09/479,545 filed Jan. 7, 2000, now U.S. Pat. No. 6,260,365.

TECHNICAL FIELD

This invention pertains generally to refrigeration and freezer units, and more specifically to a control system for such units and related methods for controlling defrost, monitoring the status of a system condenser coil, and monitoring for refrigerant leaks.

BACKGROUND OF THE INVENTION

Cooling systems are utilized in many different types of refrigeration units and freezer units. For example, commercial refrigeration and freezer units used by those in the food industry such as restaurants generally include some variation of the standard cooling system which has existed for many years. Similarly, numerous control schemes for such cooling systems are known, including control schemes for defrost operations of the cooling systems in order to eliminate frost build up on the evaporator coils of such systems. However, improvements in such defrost control schemes are continually sought.

One problem associated with such cooling systems is that air is generally passed through a condenser to remove heat from the refrigerant. The intake air to the condenser passes through the condenser coil. As particulates build up on the condenser, air flow through the coil decreases and system efficiency may be reduced. Accordingly, it would be desirable to provide the ability to detect a clogged condenser in order to clean the condenser when needed.

Another problem associated with such cooling systems is the occurrence of refrigerant leaks in the system. Accordingly, it would be desirable to provide the ability to detect such refrigerant leaks.

SUMMARY OF THE INVENTION

In one aspect of the present invention, a method of defrosting a refrigeration unit or a freezer unit involves the steps of (a) monitoring a compressor running time, (b) monitoring an evaporator coil temperature, (c) monitoring a first time period since a last cooled compartment door open alarm of the unit, (d) monitoring a second time period since a last defrost operation, (e) monitoring a third time period during which the cooled compartment door is closed, and (f) controlling initiation of a defrost operation as a function of the monitored compressor running time, the monitored evaporator coil temperature, the monitored first time period, the monitored second time period, and the monitored third time period. Various sets of conditions may be established for triggering initiation of the defrost operation.

In another aspect of the invention a method of monitoring a refrigeration system for refrigerant leaks involves (a) monitoring a running time of a compressor, (b) monitoring a temperature of a discharge line of the compressor, (c) controlling activation of a line leak alarm based at least in part upon: (i) the running time of the compressor exceeding a threshold running time; and (ii) comparison of the discharge line temperature to a threshold discharge line temperature.

Yet a further aspect of the invention provides a method of monitoring the condenser of a cooling system. The method involves (a) monitoring a running time of a compressor, (b) monitoring a temperature of a discharge line of the compressor, (c) controlling activation of a clogged condenser alarm based at least in part upon: (i) the running time of the compressor exceeding a threshold running time; and (ii) comparison of the discharge line temperature to a threshold discharge line temperature.

An electronic controller may be utilized to implement the foregoing methods in conjunction with various sensors associated with the system components.

DETAILED DESCRIPTION

Figure 1:
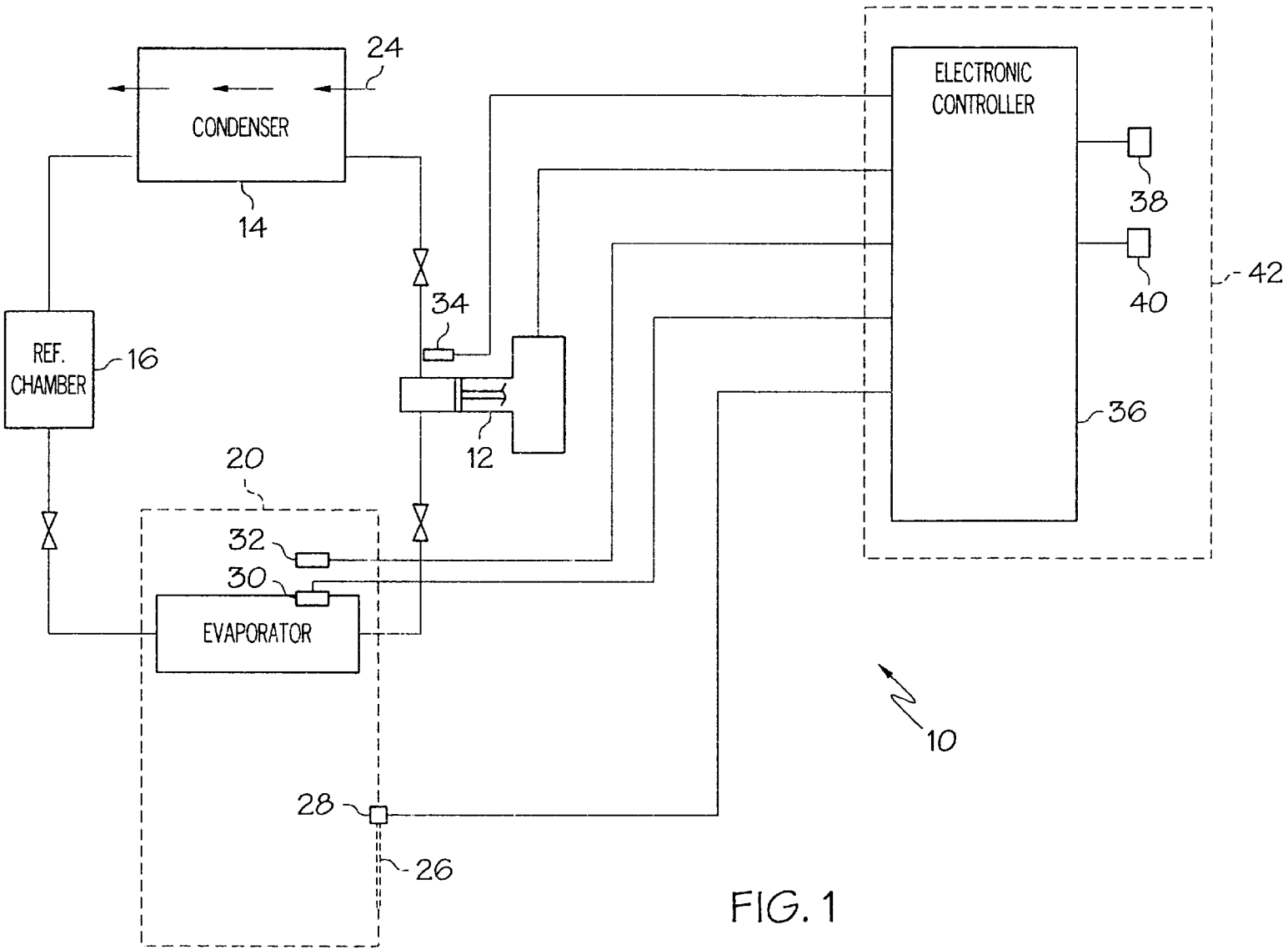
FIG. 1 is a partial schematic of a cooling system.

Referring to FIG. 1, a high-level schematic of a refrigeration system 10 is shown. The refrigeration system 10 includes a compressor 12, a condenser 14, a refrigerant chamber 16 and an evaporator 18 which typically includes an evaporator coil. As a refrigerant fluid within the system 10 enters the evaporator 18, the fluid is cooler than the surrounding area. This surrounding area is established by, or is in communication with a cooled compartment 20 in which items such as food products are kept cool or frozen. In the evaporator, refrigerant fluid in liquid form absorbs heat from the compartment 20 and vaporizes. The vaporized refrigerant is then forced into the compressor 12 where its temperature increases as a result of compression. The compressed coolant vapor passes to the condenser 14 where it cools down and liquifies as heat is transferred to the cooler air. In this regard, intake air 24 to the condenser 14 is typically passed through or over cooling coils of the condenser. The air flow may be generated by a fan unit (not shown).

The cooled compartment 20 includes a door 26 which provides access to the compartment. A switch 28 is situated to generate a signal indicative of the open/closed status of the door 26. A temperature sensor 30 is provided for generating signals indicative of the evaporator coil temperature. A combination temperature/humidity sensor 32 may also be provided for generating a signal indicative of the temperature and relative humidity of the ambient air in or around the cooled compartment 20. Separate sensors could also be utilized. A temperature sensor 34 is also provided at the discharge line of the compressor for generating signals indicative of the discharge line temperature. The temperature sensors may be of any suitable type known in the art.

An electronic controller 36 is provided for controlling the operations of the cooling system 10. Controller 36 may have various configurations but will typically include some type of processor such as a micro-processor, micro-controller, or ASIC, along with associated memory such as RAM, ROM, and/or EEPROM, and one or more associated timers or clocks. The controller 36 also includes input/output circuitry for interfacing with the various system components via electrical connections therewith. For example, the controller receives and interprets signals from sensors 28, 30, 32, and 34. The controller also controls activation of the compressor 12 via connection thereto, or via connection between the compressor and a power source (not shown). The controller 36 may also be connected to output devices 38 and 40 which may be annunciators or alarms such as light emitting elements or sound emitting elements the energization of which is controlled by the controller 36. The elements 38 and 40 may be separate from the controller or may be located in proximity to the controller 36 within the same housing. It is recognized that the cooling system 10 may include various other components and sensors which are unrelated to the various aspects of the invention. Given the foregoing system 10, the various aspects of the present invention are explained below.

Figure 2:
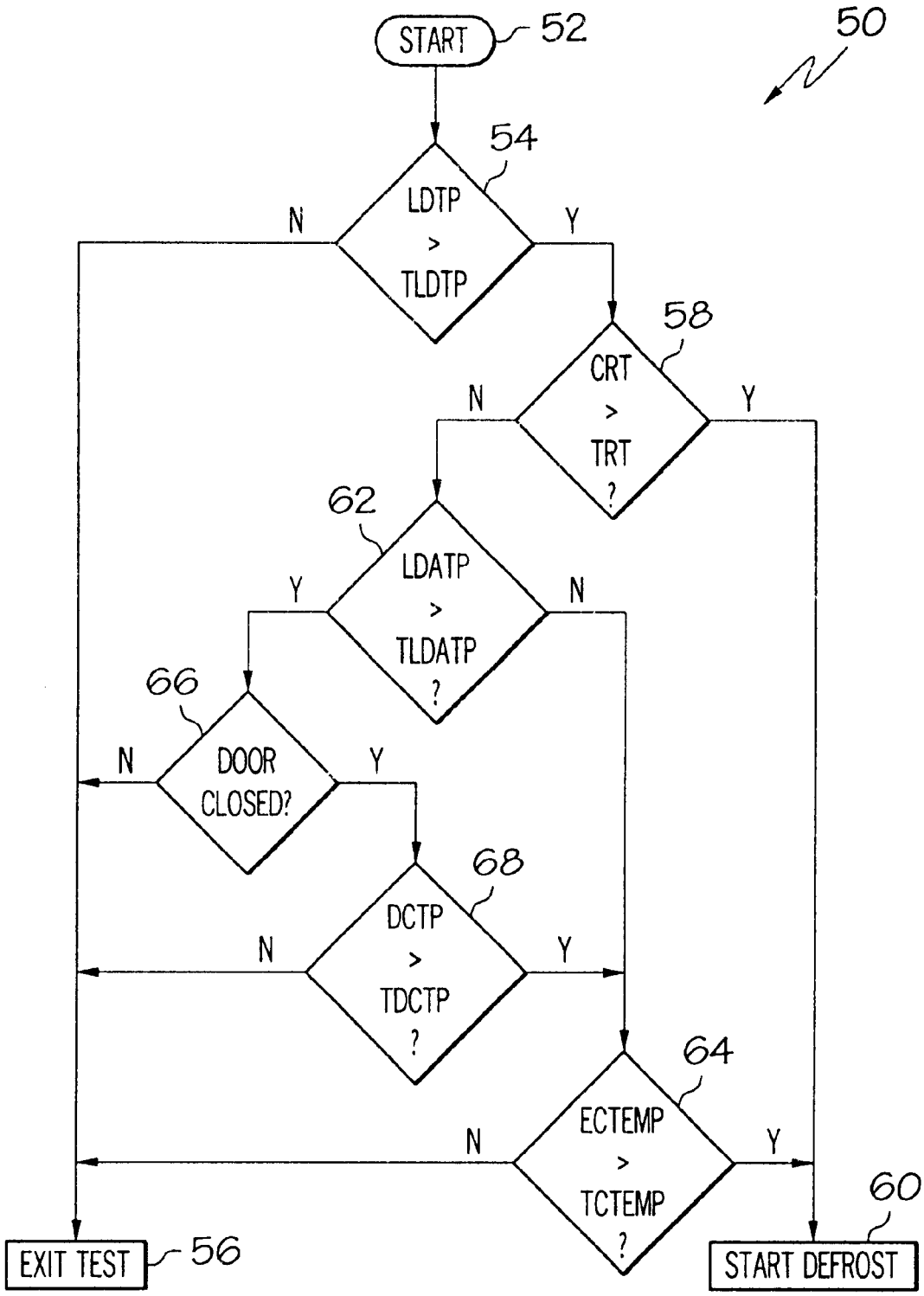
FIG. 2 is a high-level flow chart of system defrost control operation.

Reference is now made to the defrost control flow chart 50 of FIG. 2. Preferably, the controller is configured to initiate regular defrost operations at standard intervals. The standard interval may be stored in memory of the controller, and various intervals may be stored in memory to be selected according to operating conditions of the system 10. Operation according to the flow chart 50 enables an intermediate defrost operation to be initiated between the regular defrost operations if necessary. However, the control scheme of flow chart 50 could also be utilized in systems where defrost operations are not initiated at standard intervals.

In FIG. 2 the following nomenclature is utilized:

"LDTP" stands for "last defrost time period" and represents the length of time which has passed since the end of the last defrost operation;

"TLDTP" stands for "threshold last defrost time period";

"CRT" stands for compressor running time and represents the length of time during which the compressor runs during a cooling cycle of the system;

"TRT" stands for "threshold running time";

"LDATP" stands for door "last door alarm time period" and represents the length of time which has passed since end of the last cooled compartment door open alarm;

"TLDATP" stands for "threshold last door alarm time period";

"DCTP" stands for "door closed time period" and represents the length of time which has passed since the cooled compartment door was last closed;

"TDCTP" stands for "threshold door closed time period";

"ECTEMP" stands for "evaporator coil temperature" and represents the temperature of the evaporator coil as sensed by temperature sensor 30; and "TCTEMP" stands for "threshold coil temperature."

The routine of flow chart 50 may be executed periodically to determine whether or not to initiate a defrost operation. The routine will typically be initiated during a cooling cycle of the system 10, that is, when the compressor 12 is running. When called upon the routine begins at block 52 and moves to block 54 where the last defrost time period is compared to a threshold last defrost time period. The threshold last defrost time period is preferably established as a time period which is long enough to assure that the average temperature within the cooled compartment 20 does not exceed a desired level if another defrost operation is performed. For example, it is possible that if two defrost operations are performed in quick succession the average temperature of the cooled compartment may raise above a desired level for an unacceptable length of time. Accordingly, if the last defrost time period is not greater than the threshold last defrost time period, the routine is exited at block 56 and no defrost operation is performed.

On the other hand, if the last defrost time period is greater than the threshold last defrost time period the routine moves to block 58 where the compressor running time is compared to a threshold running time. The compressor running time may be maintained by a timer associated with the controller 36. The threshold running time is established as a time which indicates that the compressor has run longer than it should have to in order to cool, representing a build up of frost on the evaporator coil. Preferably, the threshold running time is established by the electronic controller based upon a running average of compressor running times over a preceding time period such as thirty-six hours. The running average may be incremented by some predetermined amount such as twenty-five percent. However, this percent is merely representative and it is recognized that the exact percent could be established for a given unit or system 10 based upon testing. If the compressor running time exceeds the threshold running time the routine moves to block 60 and a defrost operation is initiated. If the compressor running time does not exceed the threshold running time, the routine moves to block 62.

At block 62 the last door alarm time period is compared to a threshold last door alarm time period. The threshold last door alarm time period is established to account for increases in evaporator coil temperature which might result from the door remaining open for an excessive period of time, and again may be established by testing. If the last door alarm time period is not less than the threshold last door alarm time period, the routine moves to block 64 where the evaporator coil temperature is evaluated. If the current evaporator coil temperature is greater than a threshold coil temperature then the routine moves to block 60 and a defrost operation is initiated. The threshold coil temperature is established as a temperature indicative of frost build up on the evaporator coil and is preferably set at a value which is dependent upon the lowest evaporator coil temperature since the end of the last defrost operation. For example, the threshold coil temperature may be established automatically by the controller as the lowest evaporator coil temperature since the last defrost operation incremented by a certain amount. If the current evaporator coil temperature at block 64 is not greater than the threshold coil temperature, the routine is exited at block 56 and no defrost operation is performed.

Returning to block 62, if the last door alarm time period is less than the threshold last door alarm time period the routine moves to block 66 where the open/closed status of the door 26 is checked. If the door 26 is not closed the routine is exited at block 56 and no defrost operation is performed because it is undesirable to perform a defrost operation when the door is open. If the door 26 is closed the routine moves to block 68 and the door closed time period is compared with a threshold door closed time period. The threshold door closed time period is preferably established as a time period of sufficient length to allow the evaporator coil temperature to cool down and stabilize after the door has been open for an excessive period of time and may be determined by testing of the particular unit and system 10. If the door closed time period does not exceed the threshold door closed time period the routine moves to block 56 and no defrost operation is performed. However, if the door closed time period exceeds the threshold door closed time period the routine moves to block 64 and a determination of whether or not to initiated a defrost operation is made as described above.

The routine described in flow chart 50 therefore provides a defrost control system and method in which the compressor running time, evaporator coil temperature, last door alarm time period, last defrost time period, and door closed time period are monitored and in which initiation of a defrost operation is controlled as a function of the compressor running time, evaporator coil temperature, last door alarm time period, last defrost time period, and door closed time period. Preferably, a defrost operation is initiated when one or more of three sets of conditions exist. Namely, condition set 1 in which the compressor running time exceeds the threshold running time and the last defrost time period exceeds the threshold last defrost time period; condition set 2 in which the evaporator coil temperature exceeds the threshold coil temperature, the last defrost time period exceeds the threshold last defrost time period, and the last door alarm time period exceeds the threshold last door alarm time period; and condition set 3 in which the evaporator coil temperature exceeds the threshold coil temperature, the last defrost time period exceeds the threshold last defrost time period, the last door alarm time period is less than the threshold last door alarm time period, and the door closed time period exceeds the threshold door closed time period.

The electronic controller is programmed or otherwise configured to control defrost according to the flow chart 50. The electronic controller 36 may initiate a defrost operation by inhibiting operation of the compressor 12. The length of a given defrost operation may be predetermined or may vary upon other monitored parameters of the system 10. As described herein initiation of a defrost operation may include starting the defrost operation immediately when block 60 of flow chart 50 is reached, but may also include setting a flag which will cause the defrost operation to start after the compressor 12 stops running during a cooling sequence.

Figure 3:
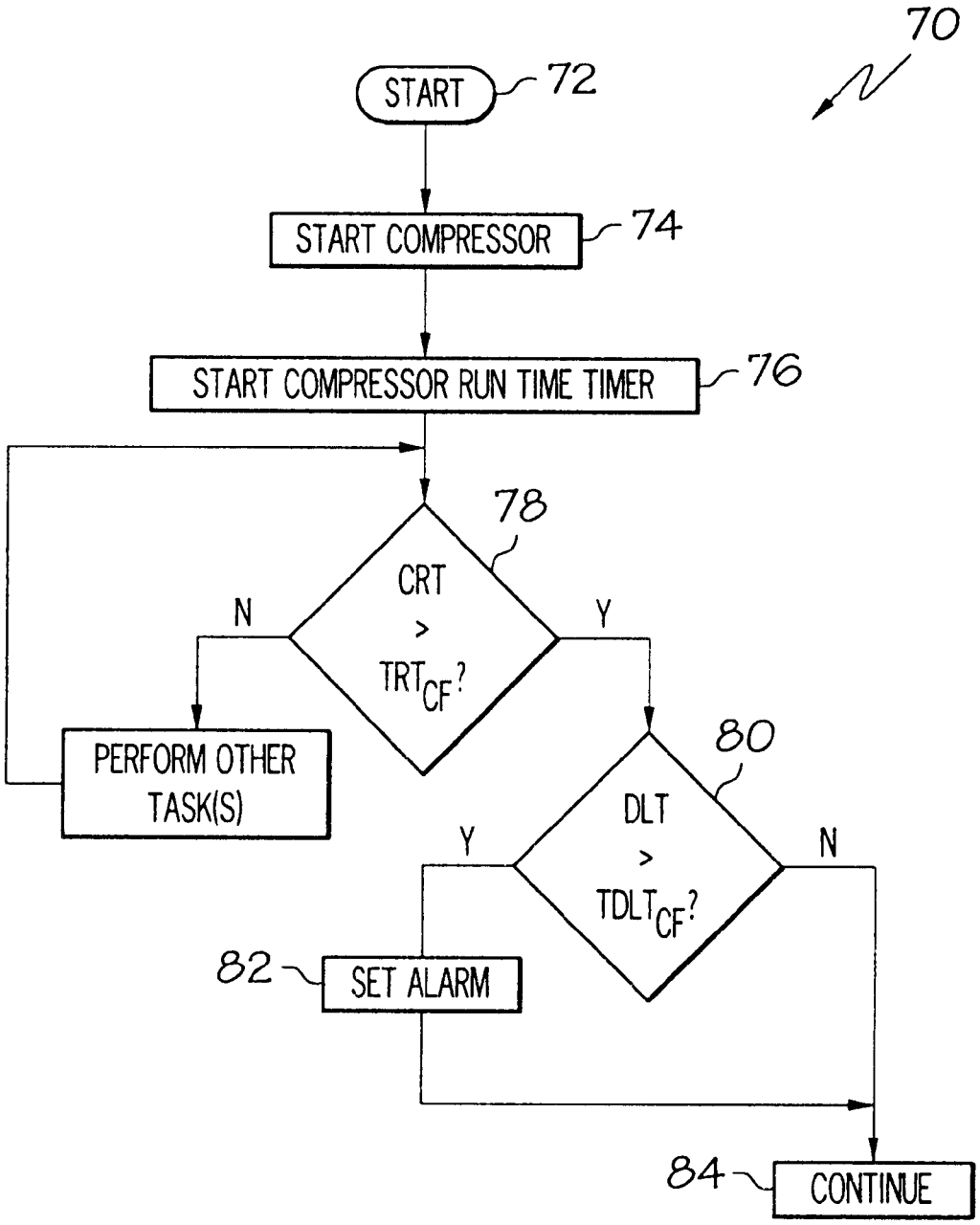
FIG. 3 is a high-level flow chart of clogged condenser detection operation.

Referring now to FIG. 3, an additional feature of the system 10 is described and provides the ability to determine when the condenser 14 of the system becomes clogged. The following nomenclature is utilized in FIG. 3:

"CRT" stands for compressor running time and represents the length of time during which the compressor runs during a cooling cycle of the system;

"$TRT_{CF}$" stands for "threshold running time" indicative of a clogged condenser;

"DLT" stands for "discharge line temperature" of the compressor; and

"$TDLT_{CF}$" stands for "threshold discharge line temperature" indicative of a clogged condenser.

The routine of flow chart 70 begins at block 72 and moves to block 74 where operation of the compressor 12 is started. At block 76 a timer for monitoring the compressor running time is started. At block 78 the compressor running time is compared to a threshold running time which is indicative of a clogged condenser. The threshold running time may be established by testing of the unit and system, by tracking prior compressor running times, or a combination of the two. If the compressor running time exceeds the threshold running time the routine moves to block 80 where the discharge line temperature is compared to a threshold discharge line temperature indicative of a clogged condenser. The threshold discharge line temperature may be established by testing of the unit and system, by tracking prior discharge line temperatures, or a combination of the two. If the discharge line temperature exceeds the threshold discharge line temperature then an alarm is initiated at block 82. The discharge line temperature check is provided to verify that the excessive compressor running time is not due to a compressor malfunction such as a refrigerant leak or otherwise caused low refrigerant level as discussed in more detail below. The alarm may be activation of one of the sound element or light element 38 or 40, or may merely be a flag which is set in memory for later retrieval. If the compressor discharge line temperature does not exceed the threshold discharge line temperature, the routine moves to block 84 where other processing may continue. Referring again to block 78, if the compressor running time does not exceed the threshold running time the routine moves to block 86 where other control operations and tasks may be performed before the routine again moves to block 78. The routine of flow chart 70 may be continuously or periodically run during a cooling cycle of the system 10.

Figure 4:
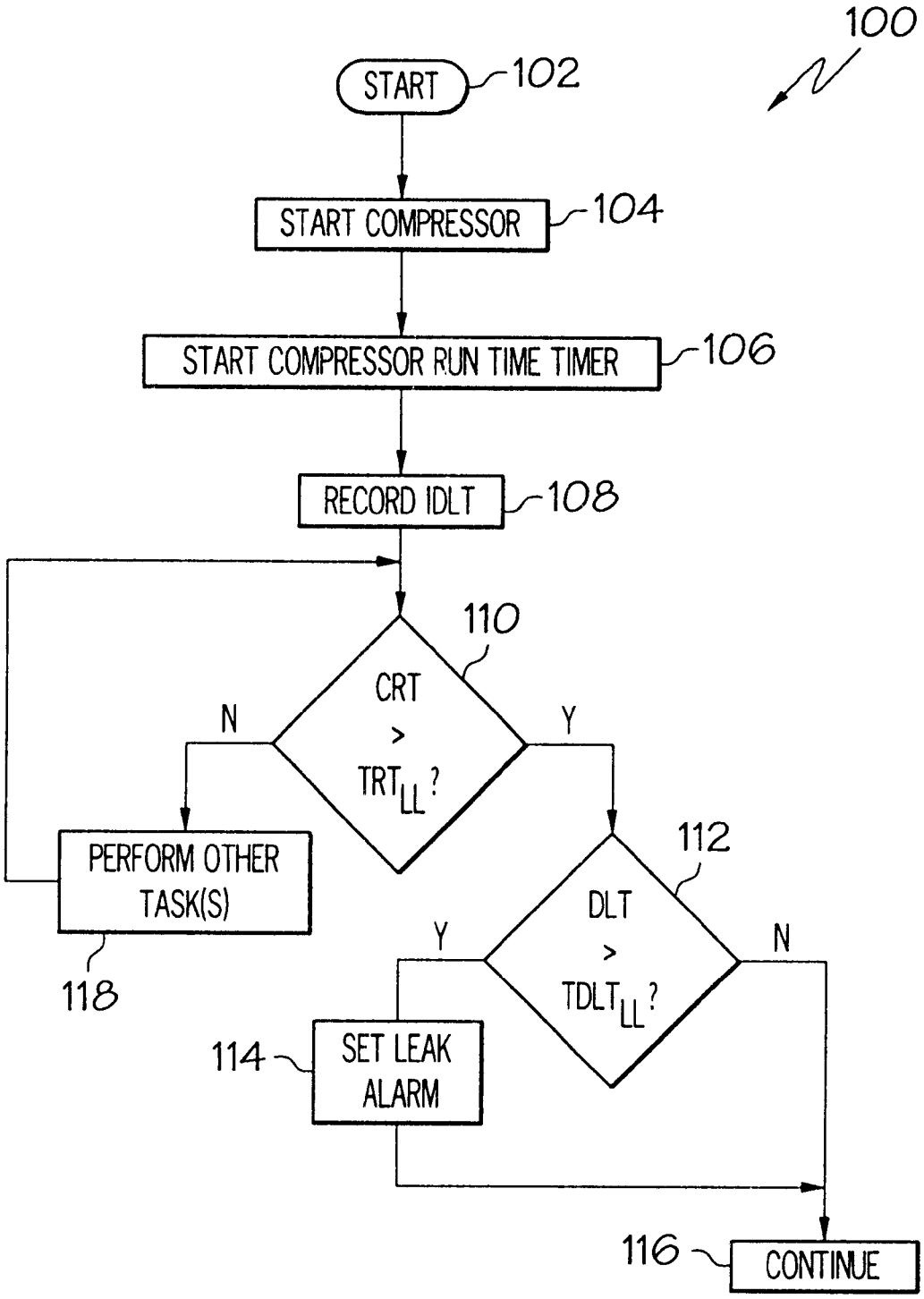
FIG. 4 is a high-level flow chart of refrigerant leak detection operation.

In FIG. 4 a flow chart 100 depicts a routine for determining when a refrigerant leak exists in the system 10. The following nomenclature is utilized in FIG. 4:

"CRT" stands for compressor running time and represents the length of time during which the compressor runs during a cooling cycle of the system;

"$TRT_{LL}$" stands for "threshold running time" indicative of a line leak in the system;

"DLT" stands for "discharge line temperature" of the compressor; and

"$TDLT_{LL}$" stands for "threshold discharge line temperature" indicative of a refrigerant line leak.

The routine of flow chart 100 begins at block 102 and moves to block 104 where operation of the compressor 12 is started. At block 106 a timer for monitoring the compressor running time is started. At block 108 the initial discharge line temperature (IDLT) is checked and recorded or stored in memory. At block 110 the compressor running time is compared to a threshold running time which is indicative of a refrigerant line leak. The threshold running time may be established by testing of the unit and system, by tracking prior compressor running times, or a combination of the two. If the compressor running time exceeds the threshold running time the routine moves to block 112 where the discharge line temperature is compared to a threshold discharge line temperature indicative of a refrigerant line leak. Preferably, the threshold discharge line temperature is based upon the initial discharge line temperature incremented by a predetermined amount established by testing. If the discharge line temperature does not exceed the threshold discharge line temperature then an alarm is initiated at block 114. This scenario is indicative of a refrigerant leak because the discharge line temperature should rise after compressor start up due to an increase in system pressure. If the refrigerant level is low—or if there is a leak in the system, the pressure cannot build and therefore the discharge line temperature will not increase as it should. The alarm may be activation of one of the sound element or light element 38 or 40, or may merely be a flag which is set in memory for later retrieval. If the compressor discharge line temperature does exceed the threshold discharge line temperature, the routine moves to block 116 where other processing may continue. Referring again to block 110, if the compressor running time does not exceed the threshold running time the routine moves to block 118 where other control operations and tasks may be performed before the routine again moves to block 10. The routine of flow chart 100 may be continuously or periodically run during a cooling cycle of the system 10.

Regarding the routines of flow charts 70 and 100, it is recognized that an excessive compressor running time could be indicative of a need for a defrost operation instead of a clogged condenser or refrigerant line leak. Therefore, in each routine a back-up check of the discharge line temperature is provided. Based upon known system performance under various circumstances, and the combination these two system checks, both clogged condensers and refrigerant leaks can be effectively monitored and detected. Given the similarity between the two routines, it is recognized that a single routine which simultaneously checks for the clogged condenser and the refrigerant leak could be provided.

While the forms of the apparatus herein described constitute preferred embodiments of the invention, it is to be understood that the invention is not limited to these precise forms of apparatus, and changes may be made therein without departing from the scope of the invention.

What is claimed is:

1. A method of monitoring a refrigeration system for a refrigerant leak, the method comprising the steps of:

(a) monitoring a compressor running time;

(b) monitoring a temperature of a discharge line of the compressor;

(c) controlling activation of a line leak alarm based at least in part upon:

(i) the monitored compressor running time exceeding a threshold running time; and (ii) comparison of the monitored discharge line temperature to a threshold discharge line temperature.

2. The method of claim 1 wherein in step (c) the line leak alarm is activated if the monitored discharge line temperature does not exceed the threshold discharge line temperature.

3. The method of claim 2 wherein the threshold discharge line temperature is determined based at least in part upon an initial discharge line temperature measured when the compressor running time begins.

4. The method of claim 2 wherein the determined line temperature comprises the initial discharge line temperature increased by a predetermined amount.

5. A method of monitoring air to a condenser of a cooling system, the method comprising the steps of:

(a) monitoring a running time of a compressor;

(b) monitoring a temperature of a discharge line of the compressor;

(c) controlling activation of a clogged condenser alarm based at least in part upon:

(i) the running time of the compressor exceeding a threshold running time; and (ii) comparison of the monitored discharge line temperature to a threshold discharge line temperature.

6. The method of claim 5 wherein in step (c) the clogged condenser alarm is activated if the monitored discharge line temperature exceeds the threshold discharge line temperature.

7. The method of claim 6 wherein the threshold running time is indicative of a clogged condenser and wherein the threshold line temperature is indicative of a clogged condenser.

8. A method of monitoring a cooling system, the method comprising the steps of:

(a) monitoring a running time of a compressor;

(b) monitoring a temperature of a discharge line of the compressor;

(c) controlling activation of at least one of a clogged condenser alarm and a line leak alarm based at least in part upon:

(i) the monitored running time of the compressor exceeding a threshold running time; and (ii) comparison of the monitored discharge line temperature to a threshold discharge line temperature.

9. The method of claim 8 wherein in step (c) activation of the clogged condenser alarm is controlled, the clogged condenser alarm is activated if the monitored discharge line temperature exceeds the threshold discharge line temperature.

10. The method of claim 8 wherein in step (c) activation of the line leak alarm is controlled, the line leak alarm is activated if the monitored discharge line temperature does not exceed the threshold discharge line temperature.

11. The method of claim 10 wherein the threshold discharge line temperature is determined based at least in part upon an initial discharge line temperature measured when the compressor running time begins.

12. The method of claim 11 wherein the determined line temperature comprises the initial discharge line temperature increased by a predetermined amount.

13. The method of claim 8 wherein in step (c) activation of both the clogged condenser alarm and the line leak alarm are controlled, the clogged condenser alarm is activated if the monitored running time of the compressor exceeds a first threshold running time and the monitored discharge line temperature exceeds a first threshold discharge line temperature, the line leak alarm is activated if the monitored running time of the compressor exceeds a second threshold running time and the monitored discharge line temperature does not exceed a second threshold discharge line temperature.

* * * * *